US008496442B2

(12) United States Patent
Yao

(10) Patent No.: US 8,496,442 B2
(45) Date of Patent: Jul. 30, 2013

(54) COMBINING STRUCTURE FOR THE DECORATING SHELL OF A CEILING FAN

(76) Inventor: Chao-chin Yao, Taichung (TW)

( * ) Notice: Subject to any disclaimer, the term of this patent is extended or adjusted under 35 U.S.C. 154(b) by 749 days.

(21) Appl. No.: 12/778,185

(22) Filed: May 12, 2010

(65) Prior Publication Data

US 2011/0280734 A1 Nov. 17, 2011

(51) Int. Cl.
*F01D 25/28* (2006.01)
*F03D 11/04* (2006.01)
*F04D 29/60* (2006.01)

(52) U.S. Cl.
USPC ..... 416/244 R

(58) Field of Classification Search
USPC ..... 415/214.1, 213.1; 416/5, 204 R, 416/244 R
See application file for complete search history.

(56) References Cited

U.S. PATENT DOCUMENTS 6,439,527 B1 * 8/2002 Lin ..... 248/343
6,790,008 B1 * 9/2004 Huang ..... 416/244 R
7,261,520 B2 * 8/2007 Wang ..... 416/244 R

* cited by examiner

*Primary Examiner* — Edward Look
*Assistant Examiner* — William Grigos
(74) *Attorney, Agent, or Firm* — Wang Law Firm, Inc.; Li K. Wang; Stephen Hsu

(57) ABSTRACT

A combining structure for the decorating shell of a ceiling fan includes an outer shell and a decorating cover. The bottom of the outer shell has a connecting hole. The rim of the connecting hole is formed upward with at least two opposite notches. Each of the notches is bent downward with a blocking rim that gradually converges. The decorating cover has an annular shape, and is mounted on the bottom of the outer shell. The inner rim of the decorating cover is protruded upward with an inner rim wall that goes through the connecting hole of the outer shell. The outer surface of the inner rim wall is protruded outward with a protruding part for each of the notches on the outer shell. The protruding parts go through the notches and urge and position on the blocking rim at the bottom of the outer shell.

3 Claims, 8 Drawing Sheets

COMBINING STRUCTURE FOR THE DECORATING SHELL OF A CEILING FAN

BACKGROUND OF THE INVENTION

1. Field of Invention

The invention relates to an outer shell structure and, in particular, to a combining structure for the decorating shell of a ceiling fan.

2. Related Art

As shown in FIG. 8, the decorating cover for the hanging bell of a conventional ceiling fan. The surrounding surface at the bottom of the hanging bell 61 is formed with several through holes 62. Several screws go through the through holes 62 to fix the hanging bell 61 under a hanging frame (not shown). Since the screws are exposed at the bottom of the hanging bell 61, it is customary to cover them with a decorating cover 63. The bottom of the hanging bell 61 converges downward to form a neck 64. The inner rim of the neck 64 is protruded toward its center with at least three urging parts 65. The inner rim of the decorating cover 63 is protruded upward with catching parts 66 corresponding to the urging parts 65. Each of the catching parts 66 is formed with a groove 67. To assemble them, as shown in FIG. 9, one only needs to align the urging parts 65 with the concave part between the catching parts, followed by rotating the decorating cover 63 so that the urging parts 65 go into the grooves 67 of the catching parts 66. This completes the assembly.

However, due to the cost constraint, the precision between the urging parts 65 and the grooves 67 is not good enough. When the space of the groove 67 is greater than the thickness of the urging part 65, there will be collisions between them when the ceiling fan is in operation. It has the drawbacks of noises and instability. If the space of the groove 67 is smaller than the thickness of the urging part 65, the drawback is that the urging parts 65 cannot be rotated into the grooves 67.

SUMMARY OF THE INVENTION

An objective of the invention is to provide a decorating shell combining structure of a ceiling fan that is cost-effective and extremely stable after assembly.

To achieve the above objective, the disclosed decorating shell combing structure includes an outer shell and a decorating cover.

The top of the outer shell has an open end connecting to the environment. The bottom of the outer shell has a surrounding surface on which a connecting hole is formed. The rim of the connecting hole is formed with at least two opposite notches, each of which is bent downward to form a blocking rim that extends along the annular direction of the connecting hole and gradually converges. The end of the blocking rim closer to the notch is defined as a guide-in end. The farther end thereof is defined as an urging end. The diameter of the blocking rim converges gradually from the guide-in end toward the urging end.

The decorating cover has an annular shape and is correspondingly disposed on the surrounding surface of the outer shell. The inner rim of the decorating cover is protruded upward with an inner rim wall going through the connecting hole on the outer shell. The outer wall of the inner rim wall is protruded outward with protruding parts corresponding to the notches on the outer shell. The protruding parts enter the blocking rim via the guide-in end thereof. They are urged by the converging urging end of the blocking rim to position therein.

BRIEF DESCRIPTION OF THE DRAWINGS

These and other features, aspects and advantages of the invention will become apparent by reference to the following description and accompanying drawings which are given by way of illustration only, and thus are not imitative of the invention, and wherein.

DETAILED DESCRIPTION OF THE INVENTION

Figure 1:
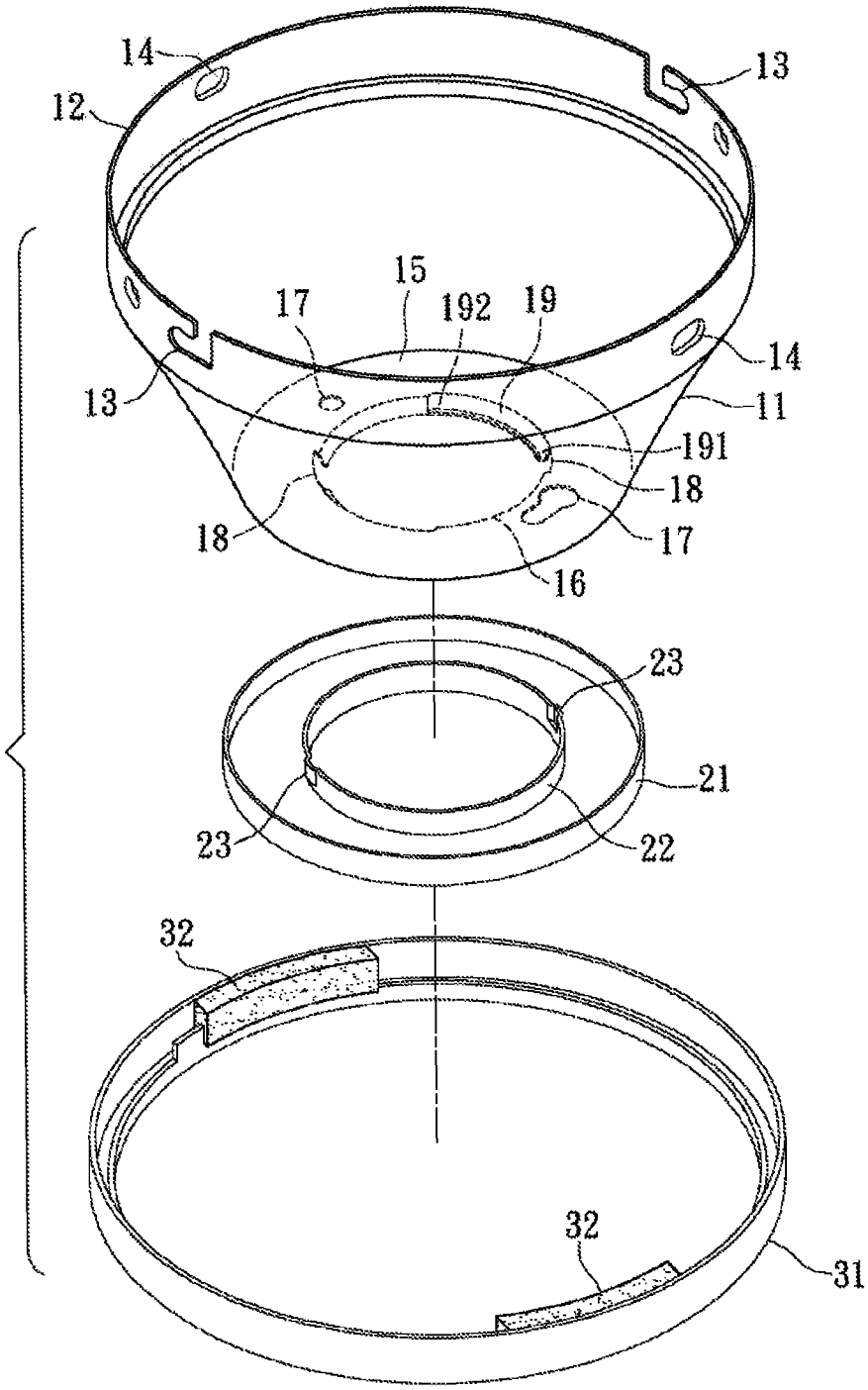
FIG. 1 is a three-dimensional exploded view of the invention.
Figure 2:
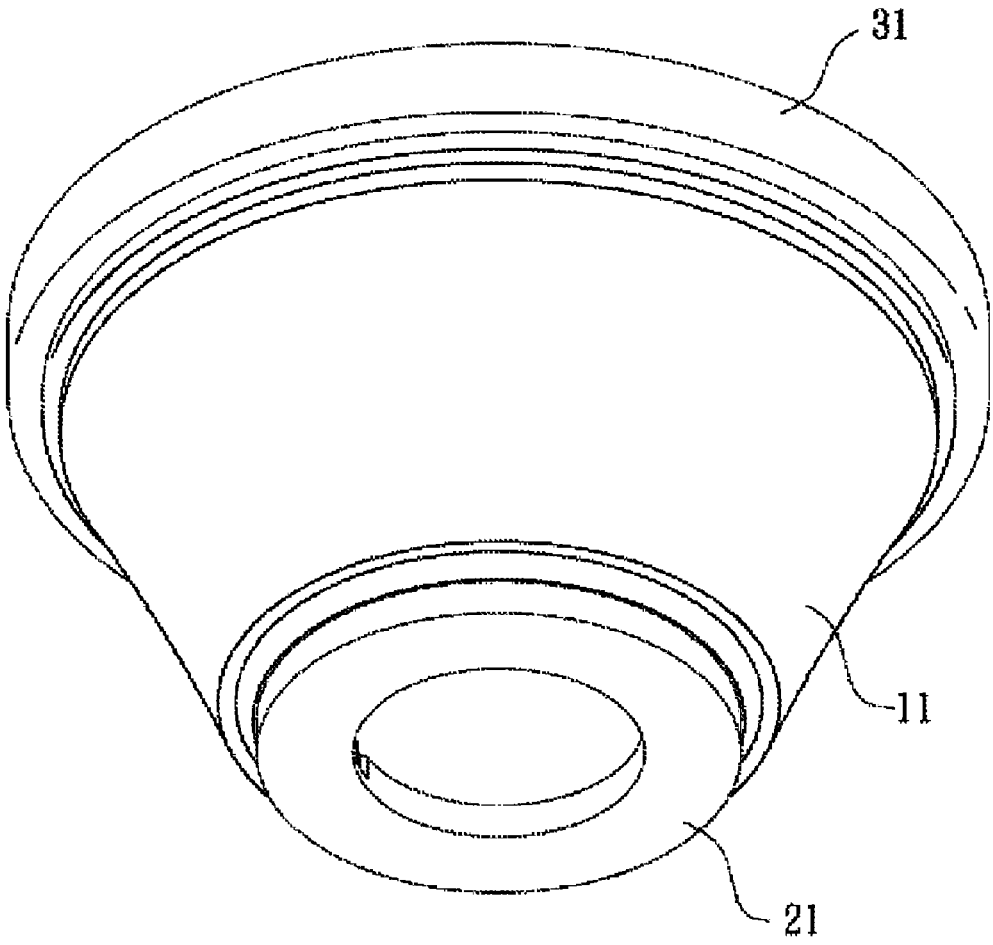
FIG. 2 is a three-dimensional perspective view of the invention after assembly.
Figure 3:
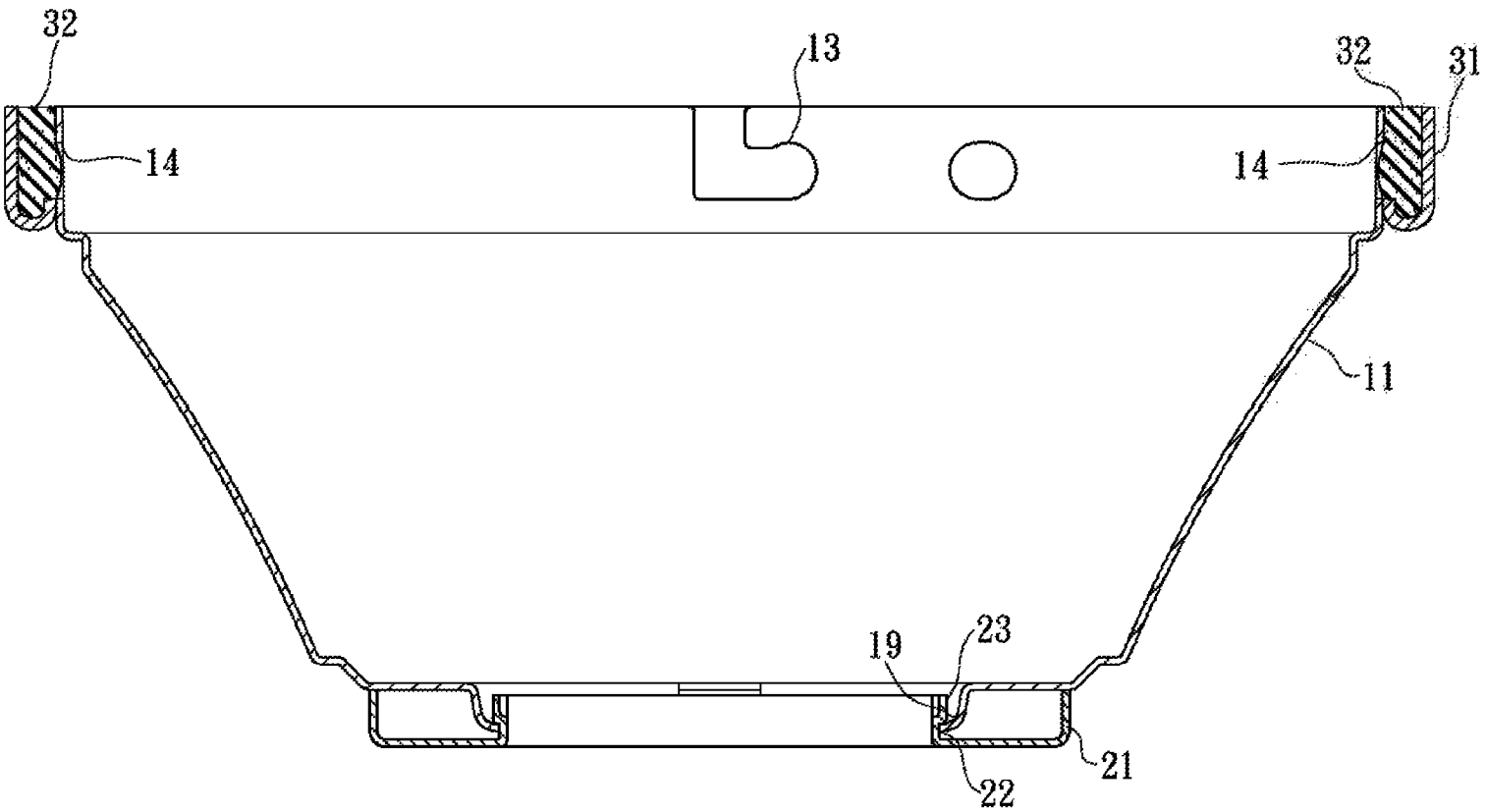
FIG. 3 is a cross-sectional view of the invention after assembly.

The present invention will be apparent from the following detailed description, which proceeds with reference to the accompanying drawings, wherein the same references relate to the same elements.

Please refer to FIGS. 1 to 4 for an embodiment of the decorating shell structure for a ceiling fan. The decorating shell structure includes an outer shell 11, a decorating cover 21, and a decorating ring 31.

The top of the outer shell 11 is formed with an open end 12 connecting to the environment via which a fixing base (not shown) is to be accommodated in the outer shell 11. The surrounding sidewall of the open end 12 is formed with several through holes 13 and positioning holes 14 at an interval. The bottom of the outer shell 11 is formed with a surrounding surface 15, whose center has a connecting hole 16 in the axial direction. The surrounding surface 15 is formed with two screw holes 17 in the annular direction of the connecting hole 16. The screw holes 17 are provided for screw elements (not shown) to go through, connecting the outer shell 11 and the fixing base. The annular rim of the connecting hole 16 is formed with two opposite notches 18, one side of each of which is bent downward to form a blocking rim 19 that extends along the annular direction of the connecting hole 16 and gradually converges. The cross-section of the blocking rim 19 is roughly an L shape and has a sealing side. The end of the blocking rim 19 close to the notch 18 is defined as a guide-in end 191. The farther side of the blocking rim 19 is defined as an urging end 192. The diameter of the blocking rim 19 gradually converges from the guide-in end 191 toward the urging end 192.

The decorating cover 21 has an annular shape and is disposed at the bottom of the outer shell 11 to cover the through holes 13. The inner rim of the decorating cover 21 is protruded upward with an inner rim wall 22 going through the connecting hole 16 of the outer shell 11. The outer surface of the inner rim wall 22 is protruded outward and horizontally with protruding parts 23 corresponding to the notches 18 on the outer shell 11. The bottom edges of the protruding parts 23 pass the guide-in end 191 of the blocking rim 19. The protruding parts 23 of the decorating cover 21 are thus guided by the guide-in end 191 of the blocking rim 19 and slide into the blocking rim 19. They are urged by the gradually converging urging end 192 and positioned therein.

The decorating rim 31 has an annular shape and an inner diameter slightly larger than the outer diameter of the top portion of the outer shell 11. It can be mounted on top of the outer shell 11 to cover the through holes 13 thereon. The inner rim of the decorating ring 31 is provided with two elastic bodies 32 corresponding to the positioning holes 14 of the outer shell 11. The inner diameter formed by the two elastic bodies 32 is slightly smaller than the outer diameter of the open end 12 on the top of the outer shell 11. The two elastic bodies 32 can be depressed due to their elasticity. The decorating ring 31 can thus be smoothly mounted on top of the outer shell 11. When the decorating ring 31 is mounted on top of the outer shell 11, the elastic bodies 32 urge against the positioning holes 14 to position the decorating ring 31.

Figure 4:
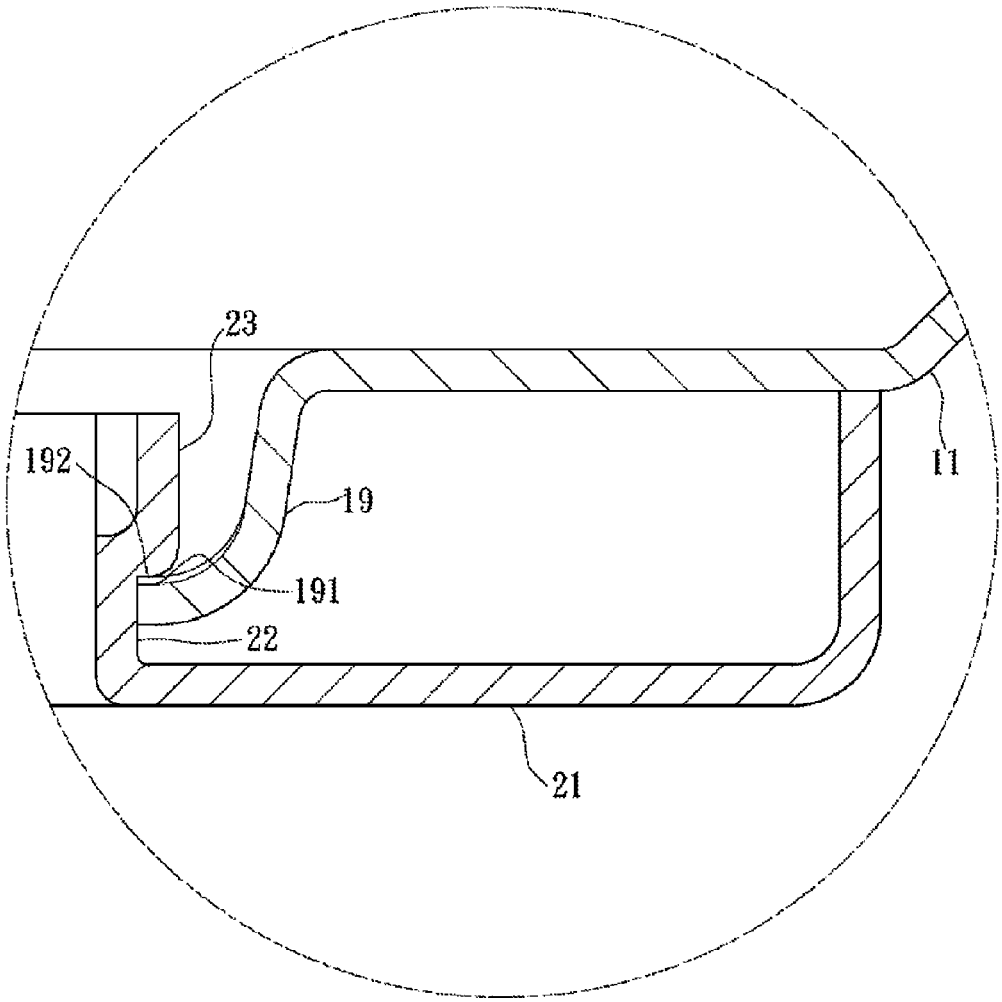
FIG. 4 is a locally exploded view of FIG. 3.
Figure 5:
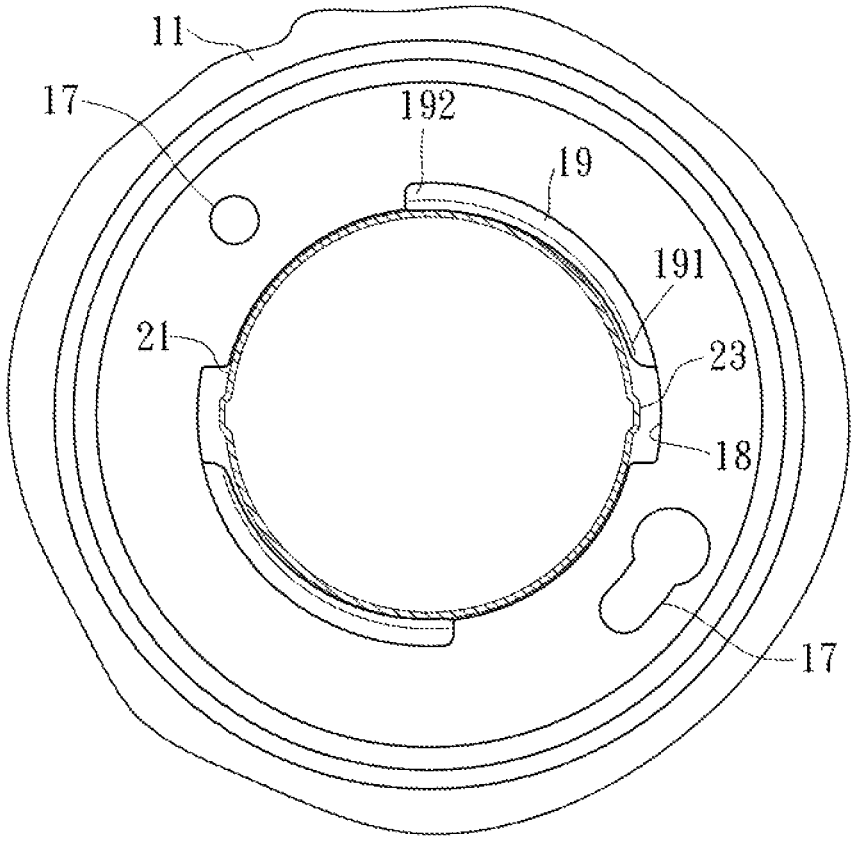
FIG. 5 shows the invention in use, when the protruding parts of the decorating cover are aligned and inserted into the notches of the outer shell.
Figure 6:
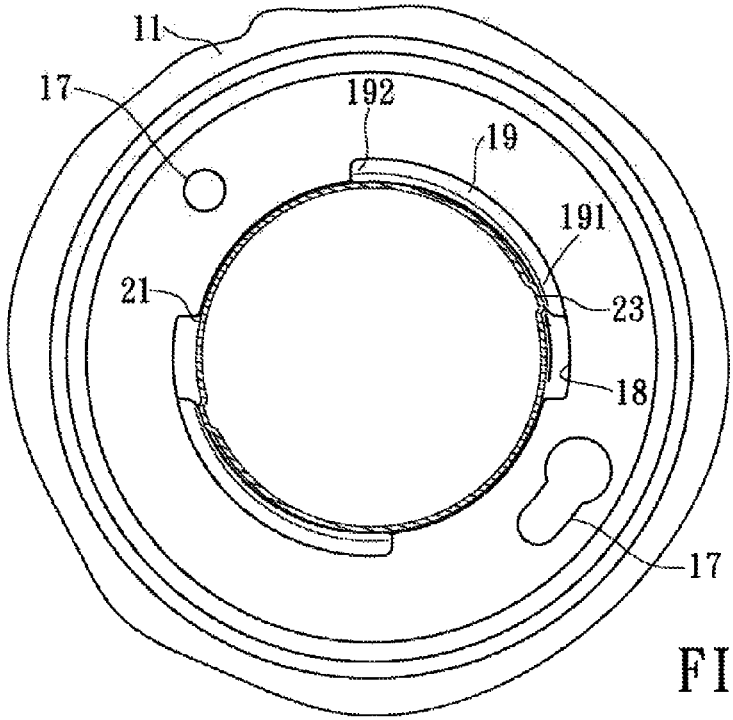
FIG. 6 shows the invention in use, when the bottom edges of the protruding parts of the decorating cover pass the guide-in end of the blocking rim.
Figure 7:
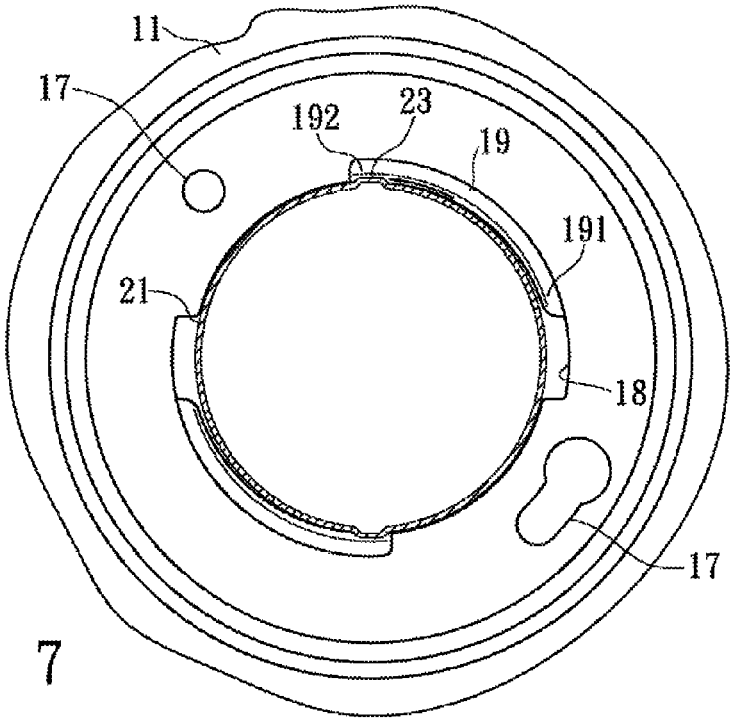
FIG. 7 shows the invention in use, when the protruding parts of the decorating cover are urged and positioned by the converging urging end of the blocking rim.
Figure 8:
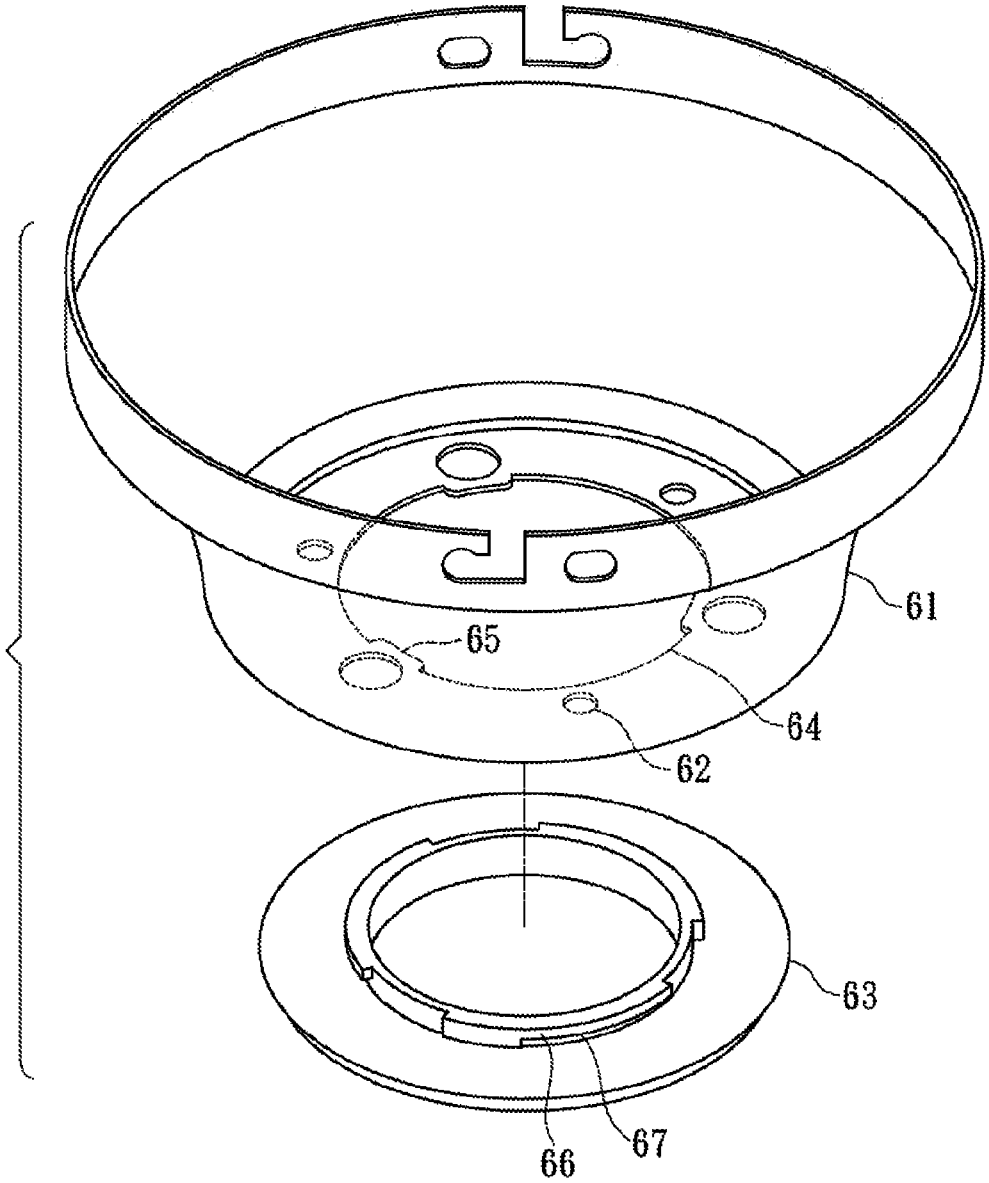
FIG. 8 PRIOR ART
FIG. 8 is a three-dimensional view of the structure of a conventional decorating cover for the ceiling fan.
Figure 9:
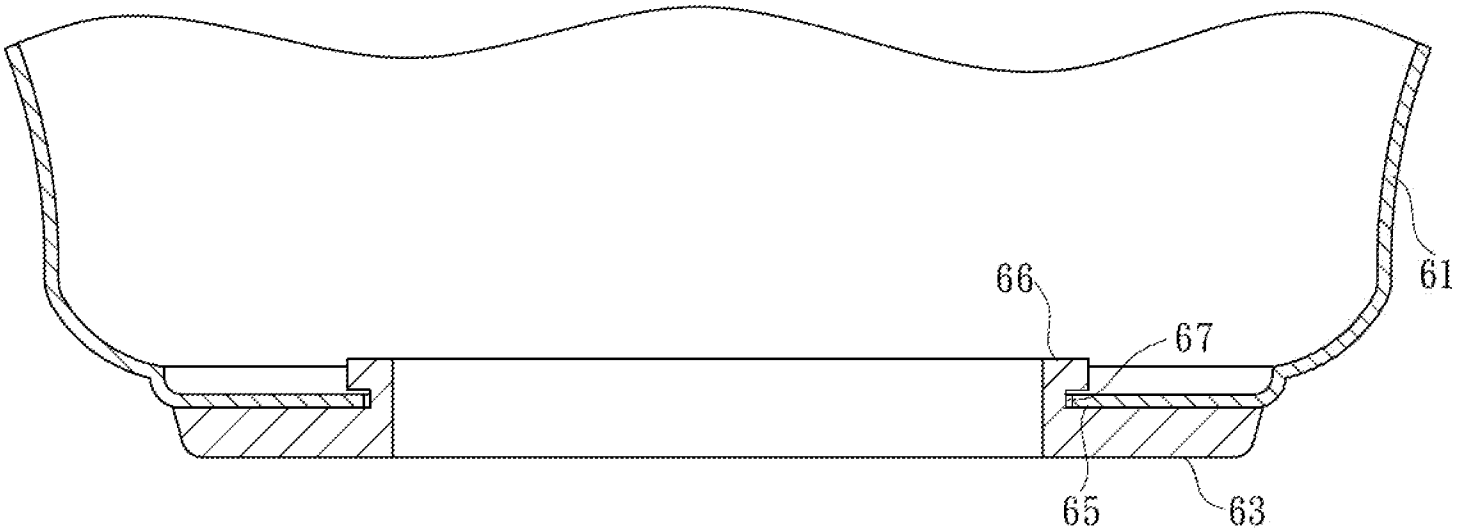
FIG. 9 PRIOR ART
FIG. 9 is a cross-sectional view of the conventional decorating cover for the ceiling fan after assembly.

Please refer to FIG. 5. To assemble the disclosed decorating cover 21 and the outer shell 11, one first align and insert the protruding parts 23 of the decorating cover 21 into the notches 18 on the outer shell 11. Then, as shown in FIG. 6, the bottom edges of the protruding parts 23 pass the guide-in end 191 of the blocking rim 19. Therefore, the protruding parts 23 of the decorating cover 21 are guided by the guide-in end 191 of the blocking rim 19 and slide into the blocking rim 19. One then continues to turn the decorating cover 21, so that the protruding parts 23 thereof rotate toward the urging end 192 of the blocking rim 19. As shown in FIG. 7 and FIG. 4, the protruding parts 23 are urged by the gradually converging urging end 192 of the blocking rim 19 and positioned therein. This achieves the effect of firmly position the decorating cover 21.

The invention with the above-described structure has the following advantages:

1. One only needs to align and insert the protruding parts 21 of the decorating cover 21 into the notches 18 on the outer shell 11, followed by turning the decorating cover 21, to complete the assembly. It is thus featured with quick assembly.

2. The blocking rim 19 is gradually converging. The protruding parts 23 are guided by the guide-in end 191 of the blocking rim 19 to slide smoothly into the blocking rim 19. The assembly is thus very easy.

3. The blocking rim 19 is gradually converging. As the protruding parts 23 of the decorating cover 21 rotate toward the urging end 192 of the blocking rim 19, they are tightly combined with the urging end 192. This effectively improves the noise problem and the drawback of instability.

4. The converging blocking rim 19 can tightly combine with the protruding parts 23 of the decorating cover 21. The blocking rim 23 can be integrally formed with the outer shell 11, achieving good assembly stability without additional control of its precision. The invention is thus easy and cheap to manufacture.

5. The decorating cover 21 and the decorating ring 31 can cover the screw elements on the outer shell 11. The ceiling thus has a more beautiful appearance.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A combining structure of decorating shell for a ceiling fan, comprising:

an outer shell whose top has an open end connecting to the environment and whose bottom has a surrounding surface, the surrounding surface having a connecting hole whose rim is formed with at least two opposite notches, each of which is bent downward to form a blocking rim that extends annularly around the connecting hole and gradually converges; wherein the end of the blocking rim near the notches is defined as a guide-in end and the farther end is defined as an urging end, with the diameter of the blocking rim converging gradually from the guide-in end toward the urging end; and a decorating cover in an annular shape and disposed on the surrounding surface of the outer shell; wherein the inner rim thereof is protruded upward with an inner ring wall to go through the connecting hole of the outer shell, the outer surface of the inner ring wall is protruded upward with protruding parts corresponding to the notches of the outer shell, and the protruding parts enter the blocking rim via the guide-in end thereof and are urged by the converging urging end of the blocking rim to position therein.

2. A combining structure of decorating shell for a ceiling fan as in claim 1, wherein the cross section of the blocking rim is roughly in an L shape with a sealing side, the protruding parts of the decorating cover pass the blocking rim with its bottom edges.

3. A combining structure of decorating shell for a ceiling fan as in claim 1, wherein the surrounding sidewall on the open end of the outer shell is formed with a plurality of positioning holes at an interval, a decorating ring in an annular shape and with an inner diameter slightly larger than the outer diameter of the top of the outer shell is mounted thereon, the inner rim of the decorating ring is provided with a plurality of elastic bodies corresponding to the positioning holes on the outer shell, the inner diameter formed by the elastic bodies is slightly smaller than the outer diameter of the open end on top of the outer shell, and the elastic bodies are depressed to urge against the positioning holes when the decorating ring is mounted on top of the outer shell.

* * * * *